US005876081A

United States Patent [19]

Melody et al.

[11] Patent Number: 5,876,081

[45] **Date of Patent: *Mar. 2, 1999**

[54] PACKAGE CARRIER AND METHOD OF MAKING SAME

[75] Inventors: Patrick F. Melody, Astoria, N.Y.; Patrick L. Farrell, Orange, Tex.

[73] Assignee: Equitable Bag Co., Ltd., New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 739,551

[22] Filed: Oct. 30, 1996

[51] Int. Cl.[6] ..... B65D 5/46

[52] U.S. Cl. ..... 294/27.1; 229/117.26

[58] Field of Search ..... 294/27.1, 137, 294/149, 1.1; 229/117.09, 117.19, 117.23, 117.26; 220/752, 757, 759

[56] References Cited

U.S. PATENT DOCUMENTS

| | | | |
|---|---|---|---|
| 1,492,100 | 4/1924 | Krueger | 294/27.1 |
| 1,524,399 | 1/1925 | Krueger | 294/27.1 |
| 1,722,052 | 7/1929 | Lackey | 229/117.26 |
| 2,069,459 | 2/1937 | Neubronner | 229/117.26 |
| 2,194,232 | 3/1940 | Peters | 294/27.1 |
| 2,846,134 | 8/1958 | Moubayed | 294/27.1 |
| 3,031,359 | 4/1962 | Blank et al. | 294/27.1 |
| 3,206,104 | 9/1965 | Cohen | 229/117.26 |
| 3,383,029 | 5/1968 | Reade | 229/117.23 |
| 4,471,870 | 9/1984 | Uhlig | 229/117.23 |
| 4,931,033 | 6/1990 | Leeds . | |
| 5,185,904 | 2/1993 | Rogers et al. | 294/27.1 |
| 5,186,542 | 2/1993 | Seabold | 294/27.1 |
| 5,419,009 | 5/1995 | Assis et al. | 229/117.26 |
| 5,680,977 | 10/1997 | Burke | 229/117.26 |

FOREIGN PATENT DOCUMENTS

| | | | |
|---|---|---|---|
| 809693 | 3/1937 | France | 229/117.23 |

OTHER PUBLICATIONS

Printed matter showing Scotch Pad Carry Handle, no date.

*Primary Examiner*—Dean Kramer
*Attorney, Agent, or Firm*—Baker & Botts, L.L.P.

[57] ABSTRACT

A package carrier which includes a band of strong material that is placed across the top of a package and affixed at opposite ends to the outer surface of the package. A handle is formed intermediate the ends of the band by folding the band and sealing interfacing portion of the band adjacent the fold.

5 Claims, 2 Drawing Sheets

PACKAGE CARRIER AND METHOD OF MAKING SAME

BACKGROUND OF THE INVENTION

This invention relates to a package carrier that can be easily affixed to the outer surface of a package and, more particularly, to a package carrier of that type which includes a sturdy handle to enable the package to be conveniently carried by the customer.

Merchandise purchased in a store is ordinarily placed in merchandising bags large enough to encompass the merchandise. Some merchandise is prepackaged or prewrapped, but it is generally placed in merchandising bags having handles to make it easier for the customer to carry the merchandise. The bags are also useful to security personnel as an indication that the contents within the bag were purchased by the customer.

The use of merchandising bags is not only expensive, but ordinarily a large inventory of bags of different sizes must be available to accommodate packages of different size. Also, placing large or heavy packages into the merchandising bags is sometimes difficult.

SUMMARY OF THE INVENTION

The package carrier of the present invention can be used for different size packages, and it is easily affixed to the outer surface of the package to be carried. When affixed to the outer surface of the package, it provides a sturdy handle that facilitates carrying the package. Since the package carrier does not conceal the package, security personnel can see what is being carried out of the store even though the package carrier is an indication that it was purchased from the store.

The package carrier of the present invention includes a band of strong material that is placed across the top of the package and affixed at opposite ends of the band to the outer surface of the package. An intermediate handle is provided by folding the band and sealing interfacing portions of the band adjacent the fold. A seal extends across the width of the band at the base of the handle, and the handle is provided with a handle opening which passes through the interfacing walls.

The package carrier of the present invention is flat before application to the package, and they can be stacked and easily packaged. In a preferred embodiment, the handle portion is folded over adjacent the outer surface of the band and detachably secured thereto.

For a more complete understanding of the present invention, reference can be made to the detailed description which follows and to the accompanying drawings.

DESCRIPTION OF PRFFERRED EMBODIMENTS

Figure 1:
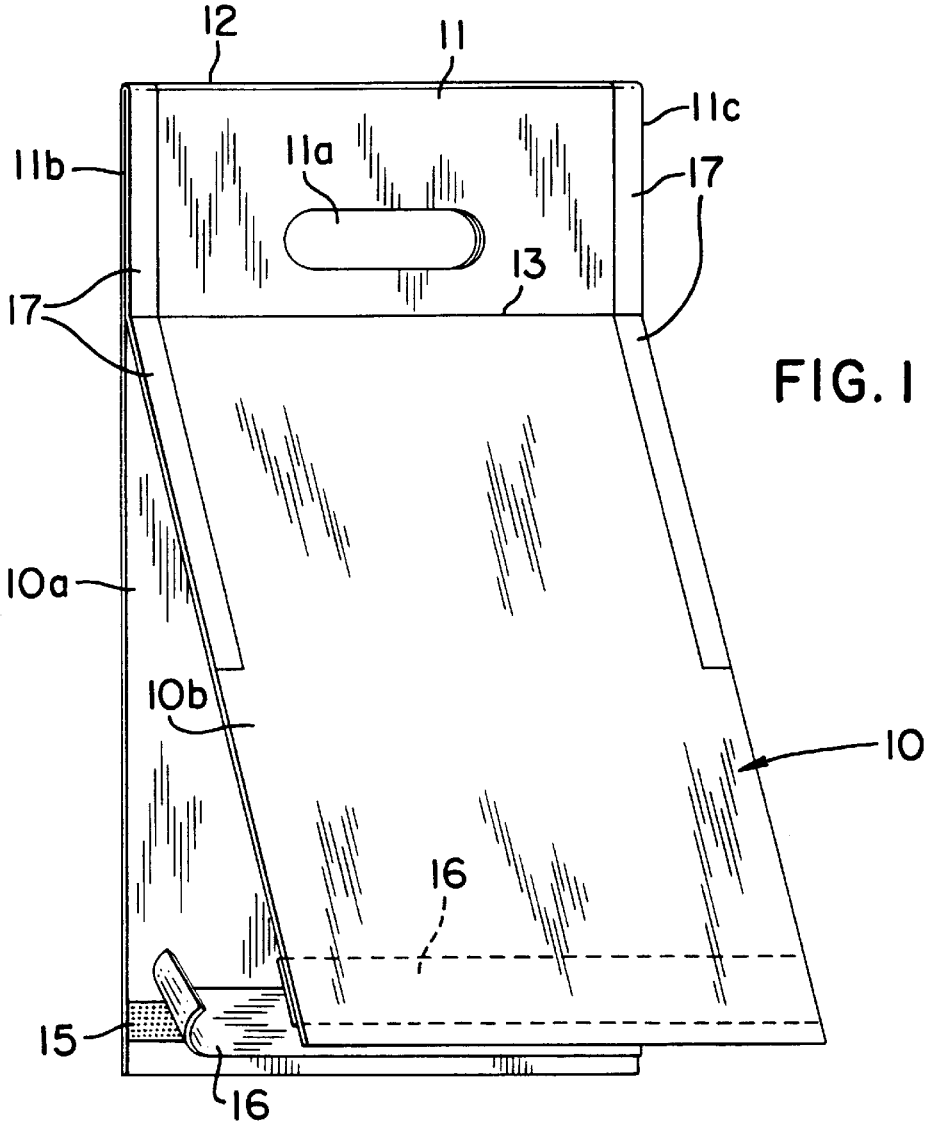
FIG. 1 is a perspective view of the package carrier of the present invention as seen from one side thereof.
Figure 2:
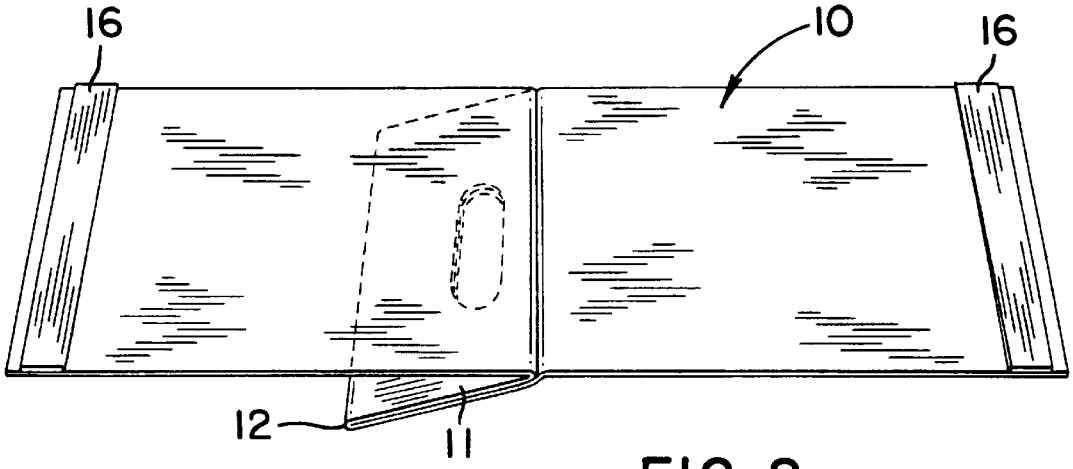
FIG. 2 is a perspective view from the bottom.
Figure 3:
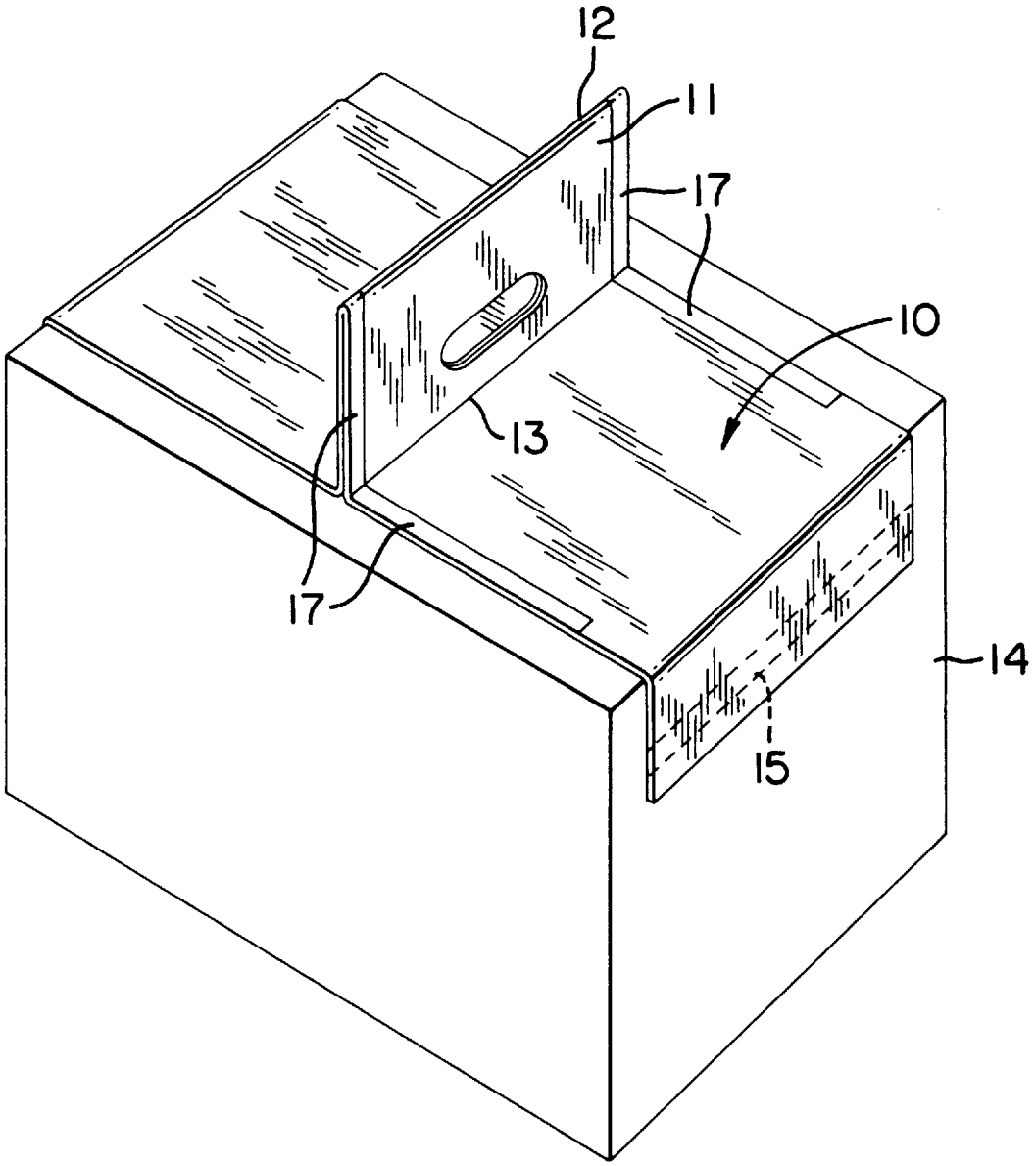
FIG. 3 is a perspective view of the package carrier affixed to a package to be carried.

The package carrier of the present invention includes a band 10 of strong plastic material having a handle 11 provided intermediate the opposite ends of the band. The outer edge of the handle is formed by a fold 12 across the width of the band, and a heat seal extends across the width of the band at the base 13 of the handle. The side edges 11*b*, 11*c* of the interfacing portions of the handle are preferably heat sealed from the base 13 to the fold 12. The handle 11 thus divides the band 10 into separate portions 10*a*, 10*b* which span the upper portion of a package 14 to be carried.

Adhesive strips 15 extend across the width of the band on the side of the band that interfaces with the package to be carried, that is to say, on the side of the band opposite the handle. The adhesive strips 15 are covered by a release tape 16 until the package carrier is ready to be affixed to a package to be carried. The release tapes easily peel off leaving the adhesive exposed on the band.

For the convenience in handling the package carrier during and after manufacture, strips 17 of a lacquer are applied along the opposite longitudinal edges on one side of the handle and along the opposite longitudinal edges of the adjacent portion 10*b* of the band so that the handle can be pivoted at its base and affixed along the lacquered portions by heat sealing to the outer surface of the adjacent portion 10*b* of the band. The lacquer can be a polyamide lacquer which will permit the handle to be heat-sealed against the outer surface of the band and easily separated for pivoting the handle about the base 13 of the handle to an upright position when the package carrier is to be applied to the package to be carried.

The band 10 is preferably made of a relatively nonstretchable, strong plastic material, such as 4 mil polyethylene, although other materials and thicknesses can be used. The adhesive 15 and release tape 16 can be a hot melt adhesive mounted on release polyethylene tape made by Lohmann and designated NST-90.

In the process for making the package carrier, a web of the plastic material is fed in the machine direction, the strips 17 of lacquer are printed on the surface of the web, the handle 11 is formed by creating a fold 12 in the machine direction between opposite edges of the web, the portions defining the handle are brought into interfacing relationship, a heat seal is formed along the base of the handle sealing the folded, interfacing portions together, the handle hole 11*a* is punched, the handle is pivoted against the web and the lacquered strips 17 are heat sealed together, the web is cut into bands by heated blades which also form the heat seals along the edges 11*b*, 11*c* of the handle and the portions 10*a*, 10*b* of the band are folded along the base 13 of the handle, thereby producing a flat package carrier which can be stacked and packaged. The heat seal at the base of the handle is preferably made by blowing hot air along the base of the handle on the side of the web opposite the handle.

The invention has been shown in a single preferred embodiment, but variations and modifications may be made therein within the spirit of the invention. The invention is not intended to be limited to any specific form or embodiment, except insofar as such limitations are expressly set forth in the claims.

We claim:

1. A package carrier that is designed to be stacked in flat condition and ready to be affixed to the outer surface of a package by a store clerk to facilitate carrying the package comprising a band of flexible plastic material, a handle intermediate opposite ends of the band, the handle including a transverse fold across the band intermediate opposite ends of the band and defining the upper edge of the handle and portions of the band in interfacing relationship adjacent the fold and affixed together along at least the base of the handle, adhesive strips extending transversely across the width of the band at each end of the band on the side of the band opposite the handle, the adhesive being confined to the ends of the band so that the span of the band is unsecured to the package between the adhesive strips, and a peel-off release tape covering each of the adhesive strips, whereby the band spans at least a part of the outer surface of a package to be carried and the adhesive strips are affixed to the package with the handle at the top of the package upon removal of the release tapes, the carrier in stacked condition ready to be affixed to the outer surface of the package being folded at the base of the handle with the surfaces of the band portions having the adhesive strips covered by the peel-off release tapes being in interfacing relationship.

2. A package carrier as set forth in claim 1 in which the carrier in stacked condition has the handle folded against the surface of the adjacent portion of the band and held thereto by a releasable sealing means.

3. A package carrier that can be stacked in flat condition and easily affixed to the outer surface of a package to facilitate carrying the package comprising a band of flexible plastic material, a handle intermediate opposite ends of the band, the handle including a transverse fold across the band intermediate opposite ends of the band and defining the upper edge of the handle and portions of the band in interfacing relationship adjacent the fold and affixed together along at least the base of the handle, adhesive strips extending transversely across the width of the band at each end of the band on the side of the band opposite the handle, a peel-off release tape covering each of the adhesive strips, whereby the band spans at least a part of the outer surface of the package to be carried and the adhesive strips are affixed to the package with the handle at the top of the package and including a handle opening formed in the handle and spaced apart releasable seals between interfacing surfaces of the handle and adjacent portions of the band, the handle opening being between the spaced apart releasable seals, to hold the handle in folded-down condition until the package carrier is ready to be applied to a package.

4. A package carrier that can be stacked in flat condition and easily affixed to the carrier surface of a package to facilitate carrying the package comprising a band of flexible material, a handle intermediate opposite ends of the band, the handle including a transverse fold across the band intermediate opposite ends of the band and defining the upper edge of the handle and portions of the band in interfacing relationship adjacent the fold and affixed together along at least the base of the handle, adhesive strips extending transversely across the width of the band at each end of the band on the side of the band opposite the handle, a peel-off release tape covering each of the adhesive strips, whereby the band spans at least a part of the outer surface of the package to be carried and the adhesive strips are affixed to the package with the handle at the top of the package and in which the handle is pivoted about the base against the outer surface of the band adjacent the handle and including longitudinally extending releasable seals along opposite edges of the band between the interfacing surfaces of the handle and adjacent portions of the band to hold the handle in folded-down condition until the package is ready to be applied to a package while leaving unsealed the interfacing surfaces between the longitudinally extending edge seals.

5. A package carrier as set forth in claim 4 in which a release lacquer is printed on the surfaces of the handle and a portion of the band to be sealed together to facilitate release of the handle.

* * * * *